United States Patent [19]

Wilkening

[11] Patent Number: 5,014,683

[45] Date of Patent: May 14, 1991

[54] HIGH EFFICIENCY FIREPLACE AND METHOD OF OPERATION

[76] Inventor: Donald W. Wilkening, Rt. 2, Box 93A, Akeley, Minn. 56433

[21] Appl. No.: 427,745

[22] Filed: Oct. 27, 1989

[51] Int. Cl.[5] ..... F24B 1/189

[52] U.S. Cl. ..... 126/515; 126/517; 126/518; 126/540; 126/163 R; 126/163 A

[58] Field of Search ..... 126/515, 517, 518, 540, 126/163 R, 163 A

[56] References Cited

U.S. PATENT DOCUMENTS

| | | | |
|---|---|---|---|
| 4,173,967 | 11/1979 | Brown | 126/163 R X |
| 4,350,139 | 9/1982 | Robichaud | 126/163 R X |
| 4,362,146 | 12/1982 | Schuller | 126/163 A X |
| 4,392,477 | 7/1983 | Milligan | 126/163 R |

*Primary Examiner*—Larry Jones

*Attorney, Agent, or Firm*—Warren A. Sturm

[57] ABSTRACT

A fireplace combustion system in which a sealed firebox contains: a base having apertures connected to a source of combustion air and wherein a hollow grate is connected to one of the apertures to conduct combustion air to a quantity of fuel disposed on the grate; a plurality of baffles and deflectors are utilized to direct the products of combustion above the grate for flow through a quantity of porous refractory material so that the refractory material is heated by the products of combustion to a temperature sufficient to ignite the unburned gases present; and a flue for exhausting the products of combustion. The grate is provided with a plurality of apertures at various levels above the bottom to supply combustion air at varying temperatures at different locations in the burning fuel. Suitable valve means are used to control the amount and direction of the air flow through the apertures in the base to different primary and secondary burning zones in the firebox.

11 Claims, 6 Drawing Sheets

HIGH EFFICIENCY FIREPLACE AND METHOD OF OPERATION

BACKGROUND OF THE INVENTION

1. Field of the Invention

This invention relates generally to combustion systems and is more particularly directed to a combustion system for efficiently burning elongated logs or sticks of wood products in a closed firechamber.

2. Prior Art

Representative prior art relating to the general field of my invention may be seen in the following patents:

| U.S. Pat. No. | PATENTEE | ISSUE DATE |
|---|---|---|
| 14,447 | Dodge | March 18, 1856 |
| 2,443,910 | Higley | June 22, 1948 |
| 4,201,185 | Black | May 6, 1980 |
| 4,291,669 | Herne, Jr. | September 29, 1981 |
| 4,380,228 | Crowley | April 19, 1983 |
| 4,440,146 | Audino, Jr. et al. | April 3, 1984 |
| 4,470,399 | Pitha | September 11, 1984 |
| 4,473,059 | Nason | September 25, 1984 |
| 4,545,360 | Smith et al. | October 8, 1985 |
| 4,553,526 | von Conta | November 19, 1985 |
| 4,557,250 | Kramert | December 10, 1985 |

Of the listed patents, a number of related structures are shown, for example, in U.S. Pat. Nos. 4,291,669; 4,380,228; 4,440,146; 4,545,360; 4,553,526; and 4,557,250, however none of these utilize the combination of elements of which my invention is comprised.

BRIEF DESCRIPTION OF THE INVENTION

A method and apparatus for practicing the method will be set forth in detail below, however, briefly, my invention includes the concept and apparatus of providing a hollow firechamber in which a hollow grate is disposed for receiving a quantity of fuel to be burned and the grate is provided with a plurality of apertures for introducing combustion air at suitable locations so as to flow onto and above the fuel disposed within the confines of the grate to provide primary combustion air to initiate pyrolization, a first secondary volume is established over the fuel on the grate to effect a first secondary burning of the gases of combustion, an upwardly disposed secondary burning means in the form of a quantity of refractory material disposed above the fuel on the grate to be heated by the rising combustion gases therefrom to establish a second secondary volume over said first secondary volume to effect further secondary burning of the products of combustion thereat, disposing the refractory material on a baffle means to direct further combustion air to the products of combustion exhausting from the top of the refractory material to establish a third secondary volume for effecting a secondary burning of unburned gases in the products of combustion prior to the exhausting of the residue of the products of combustion thereat through an appropriate flue.

My improved firechamber is provided with a hollow grate which has a hollow base serving as a plenum into which combustion air may be introduced through suitable regulating valve means. Combustion air may also be introduced to the firechamber by a further regulating means and into a plenum that is defined at the lower front access opening which contains a plurality of apertures which may supply air to the rear of, for example, glass doors sealingly disposed over an access opening into the interior of the firechamber.

A hollow grate is provided with a hollow base and a plurality of hollow upstanding members, or riser tubes, for receiving and confining a quantity of fuel to be burned that may be placed therein intermediate opposing tubes for the pyrolization process. The rising tubes are provided with an aperture at the top and sidewardly facing apertures facing inwardly of each of the four side tubes and sidewardly facing apertures disposed on either side of centrally disposed tubes for purposes to be explained in detail in the accompanying description.

DESCRIPTION OF THE ILLUSTRATED EMBODIMENT

Figure 1:
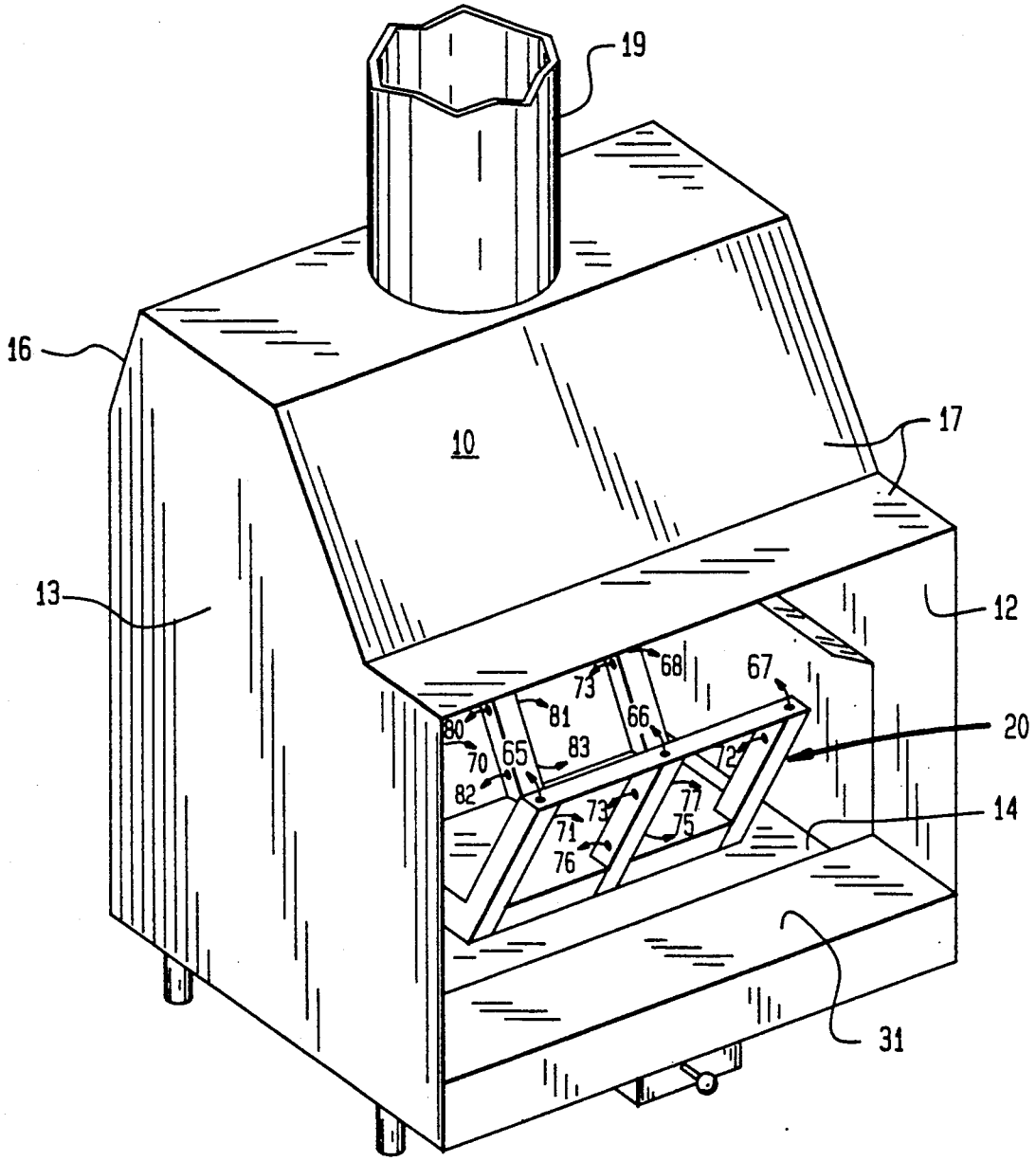
FIG. 1 is a perspective sketch of a firechamber with doors removed embodying the principles of my invention.
Figure 2:
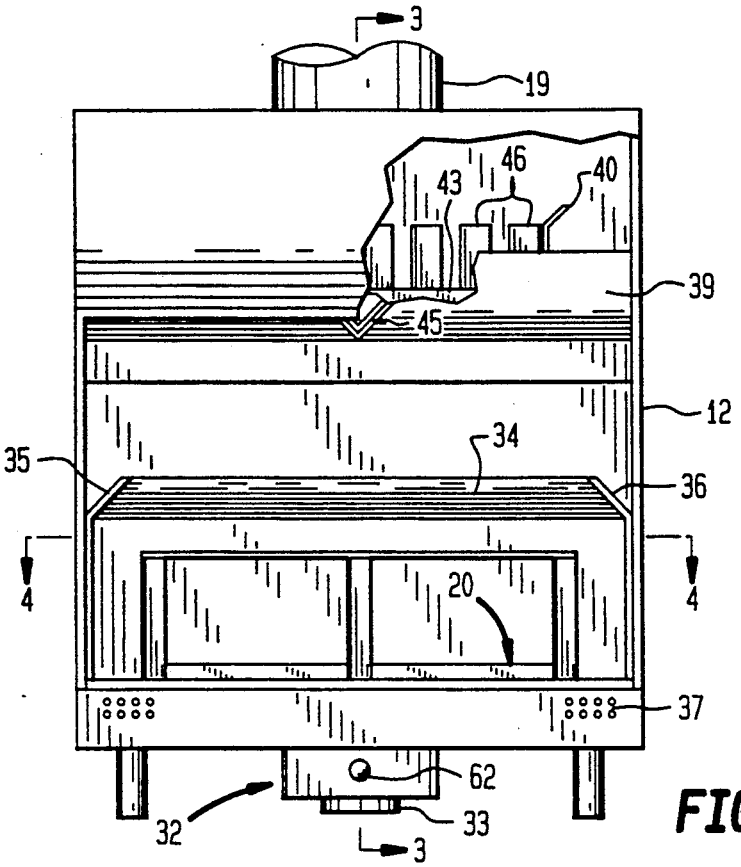
FIG. 2 is a front elevational view of the apparatus of FIG. 1.
Figure 3:
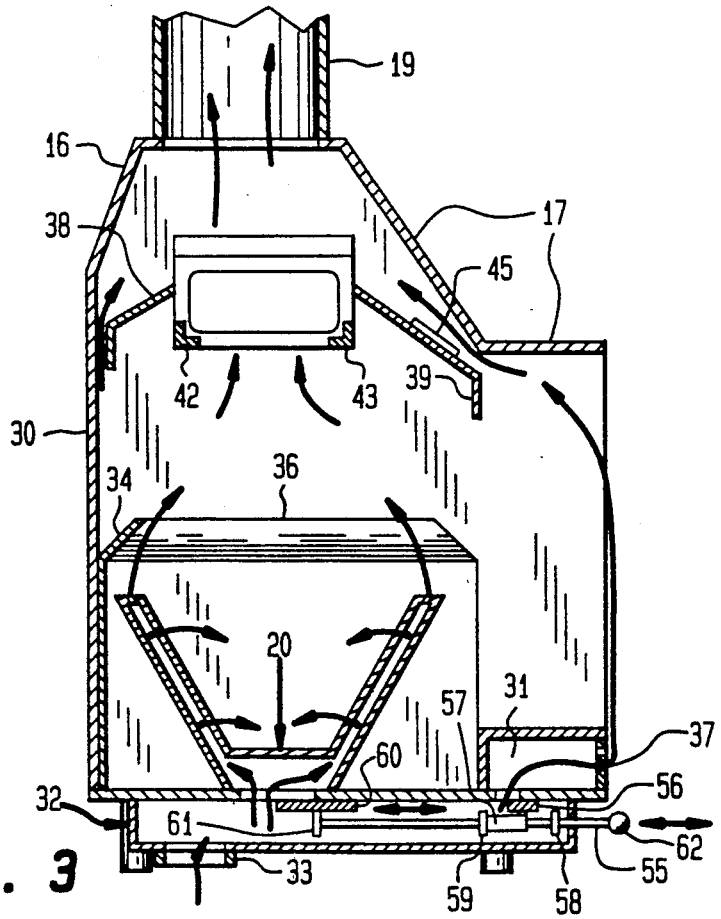
FIG. 3 is a side elevational sectional view taken along section line 3—3 on FIG. 2.

Referring now to the drawings in which like reference characters have been applied to like elements, my invention is shown comprised of a firechamber 10 containing a hollow grate 20 and an upper combustor comprised of refractory material 46, a pair of doors 50 and 52, and an exhaust flue 19.

Firechamber 10 includes a top 11, rear wall 30, side members 12 and 13, a bottom member 14 having a front hole 15 and a rear hole 16, a top front member 17 and a top back member 16, all comprised of suitable rigid material, such as steel, and welded to provide a structurally sound and stable heat resistent fire enclosure. A front plenum 31 is disposed along the bottom front of the access opening in firechamber 10 and side and rear deflector baffles 35, 36, and 34 are mounted on the inner sides of sidewalls 12 and 13 and rear wall 30 for purposes to be explained below. The front of plenum 31 is covered by member 37 having a plurality of spaced perforations adjacent the top. Top 11 of firechamber 10 is connected to a suitable flue 19 for exhausting products of combustion.

A hollow grate 20 having a hollow base 21 disposed upon and securely mounted to bottom 14 over hole 15 is shown comprised of six riser tubes or hollow legs 22, 23, 24, 25, 26 and 27 that are disposed on suitable openings in the front and rear sides of base 21 of grate 20 and welded thereto to form an air-tight seal and are covered at the top ends through front and rear top members 28 and 29 to cover the upper ends. Tubes 21–27 are disposed at an angle with respect to the front and rear of firechamber 10 and serve to receive a quantity of elongated fuel logs, or the like. An air plenum shown as rectangular duct 32, having an air inlet 33 adapted to be connected to a source of combustion air, is shown disposed under bottom 14 in chamber 10 and extends over openings 15 and 16 and channels 63 and 64 adapted to receive regulator front and rear slide elements 56 and 60, respectively, for movement longitudinally therein to cover and uncover openings 15 and 16. While grate 20 is shown as having six legs, it may be readily apparent to those skilled in the art that what is required is a sufficient plurality of legs to adequately confine the fuel and this may vary between four and a large number depending upon the configuration and size of the firechamber as well as the type of fuel to be utilized.

A regulator rod 55 extends through the front end of plenum 32 and is slideably disposed in a tubular mount 57 that is stationarily disposed under front slide 56. Front and rear stops 58 and 59 are disposed on either side of tubular mount 57 on regulator rod 55. Rear slide 60 is connected to rod 55 through mounting connector 61 extending downwardly of rear slide 60. As will be explained below, front and rear regulator slides 56 and 60 are operated through movement of rod 55 to cover and uncover holes 15 and 16 to control the flow of combustion air to the interior of firechamber 10. A plurality of sections of refractory material, shown in the form of fire bricks 46, are shown in longitudinally spaced disposition upon a rack comprised of side members 40 and 41 and angle members 42 and 43, mounted in juxtaposition above grate 20 by rear baffle 38 and front baffle 39, having a V-shaped deflector baffle disposed on the front upper side. Baffles 38 and 39 extend completely across the firechamber between side members 12 and 13 and may be welded in place. The refractory material might also be fabricated from a single piece of, for example, ceramic, having appropriate porousity in the center section and including suitable baffles adapted to be mounted on brackets or the like disposed on the top inner sides of side walls 12 and 13.

Figure 8:
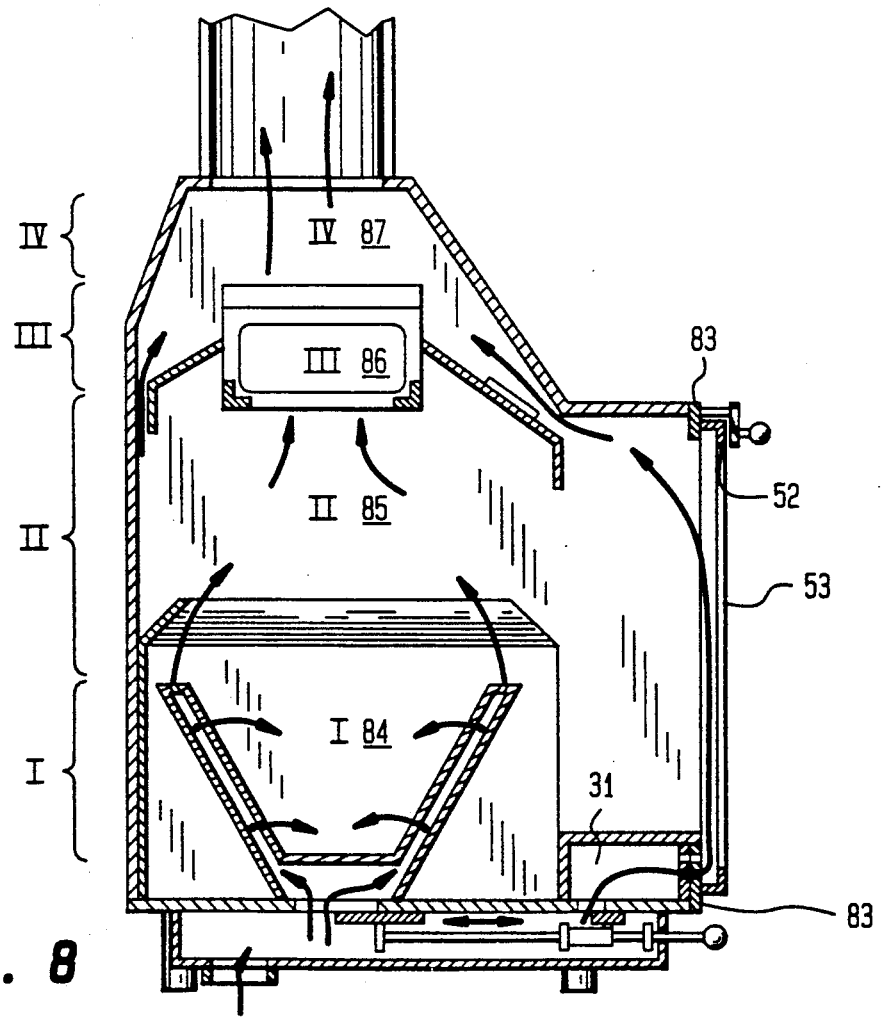
FIG. 8 is like FIG. 3 with a face frame and doors added.
Figure 5A:
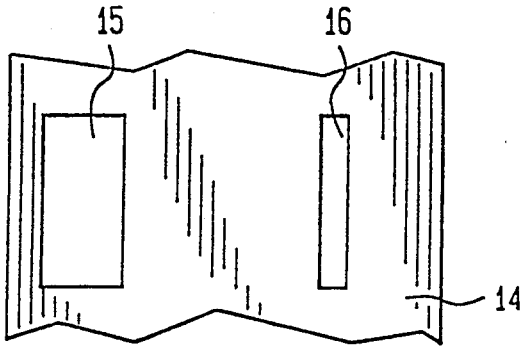
FIGS. 5A, 5B, 5C, 5D and 5E are a family of sketches illustrating the configuration of an air regulating apparatus that is used in the illustrated embodiment.
Figure 5C:
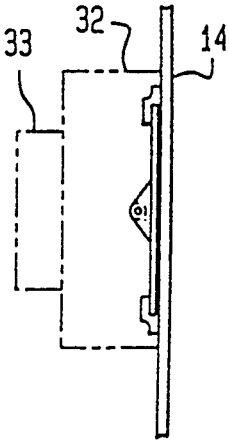
Figure 5B:
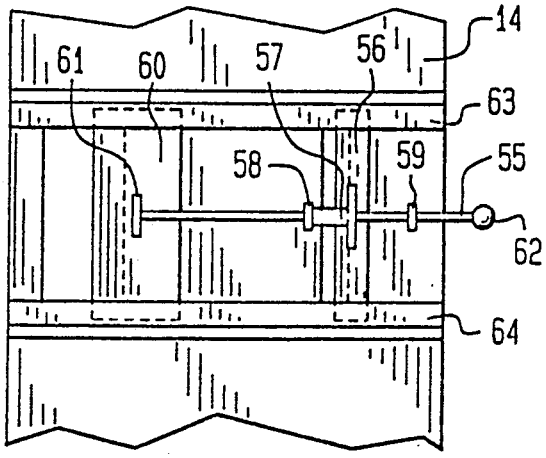
Figure 5D:
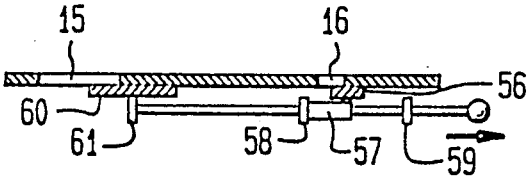
Figure 5E:
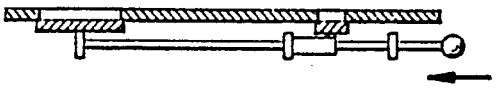
Figure 6:
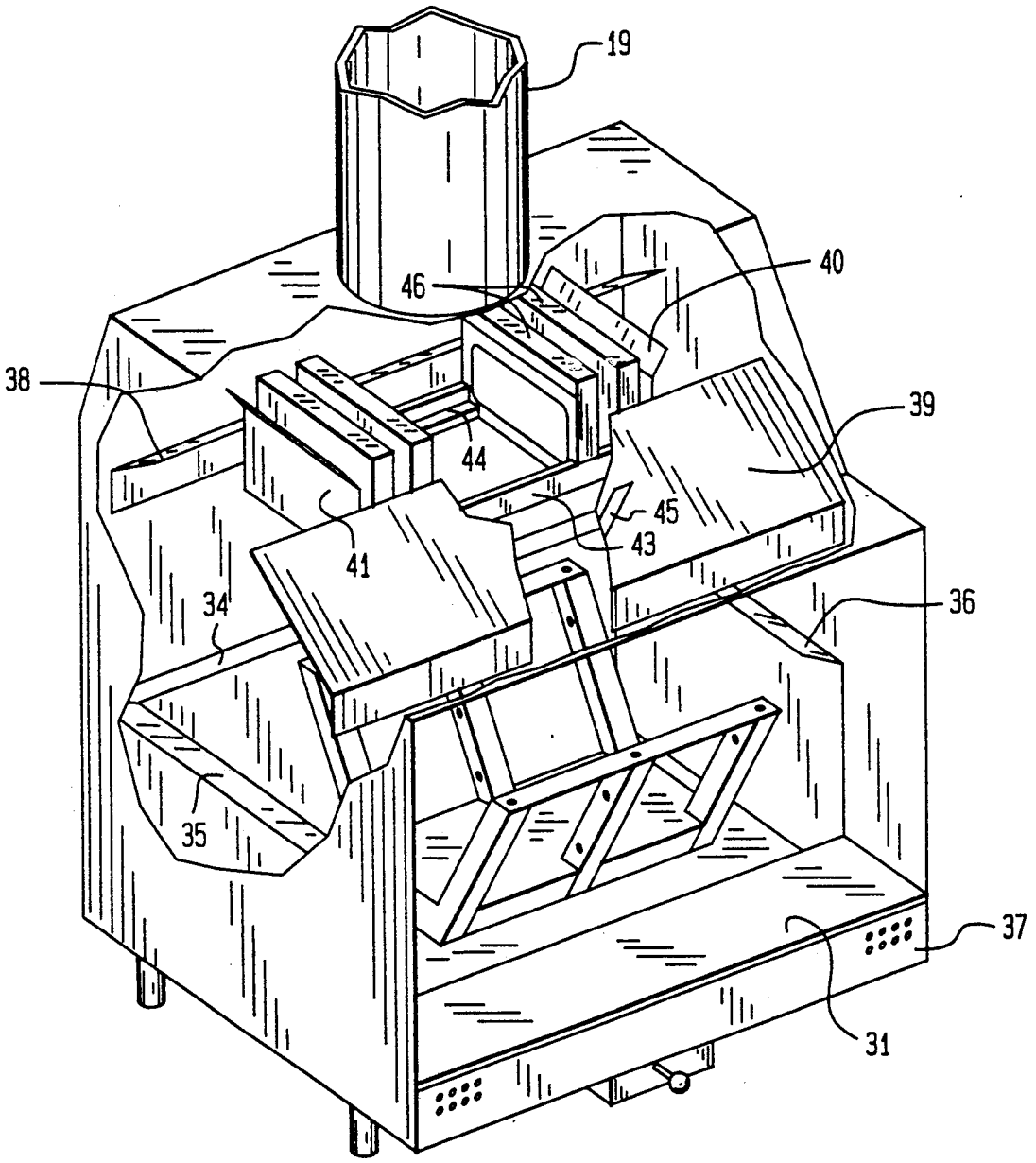
FIG. 6 is a perspective sketch as in FIG. 1 with broken away sections showing the relationship of various elements of the illustrated embodiment.
Figure 7:
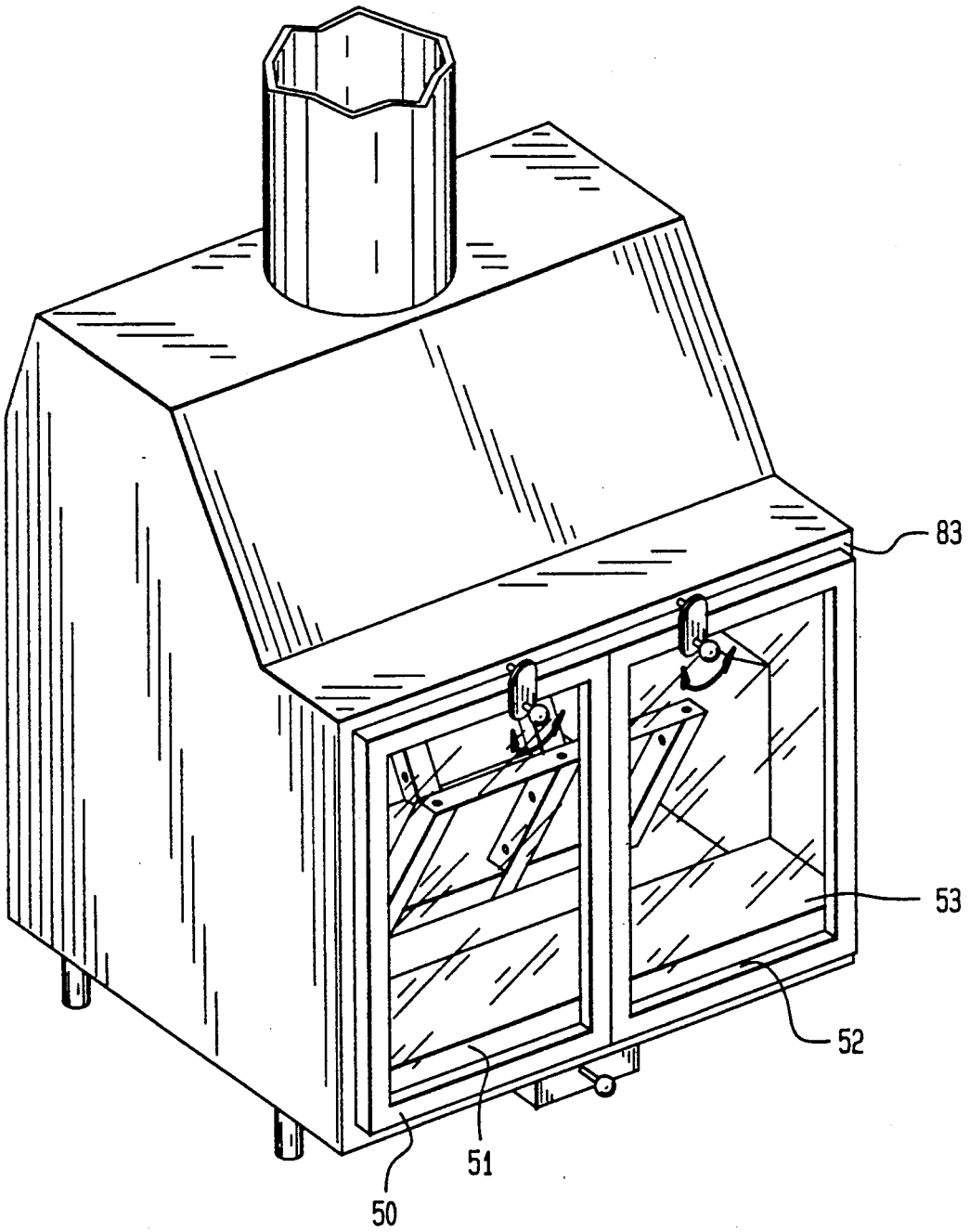
FIG. 7 is a complete firechamber including a pair of glass-covered doors.

Referring specifically to FIGS. 7 and 8 a pair of doors 50 and 52, each having transparent glass panels 51 and 53, are shown disposed over and in sealing relationship with the front of face frame 89 on firechamber 10. The lower portions of doors 50 and 52 overlie the top of perforated plenum cover 37 so that when air is admitted to plenum 31, it may flow upwardly across the inside surfaces of doors 50 and 52 and into the top front and over the sides of baffles 38 and 39.

FIG. 8 illustrates the presence of a primary, pyrolizing process volume indicated by reference character 84 and I in firechamber 10 that is substantially within the confines of grate 20, a first secondary combustion volume indicated by reference character 85 and II, a second secondary combustion volume indicated by III and reference character 86 and a third secondary combustion volume indicated by IV or reference character 87. As may now be understood, there are a plurality of combustion zones, in the illustrated example consisting of a primary zone I at and about the supply of solid fuel to be burned, and a plurality of secondary zones II, III and IV disposed in serial relationship between the top of the fuel and an exhaust flue and each of these zones is provided with combustion air in varying amounts and temperatures to provide the improved efficiency of my firechamber.

Figure 4:
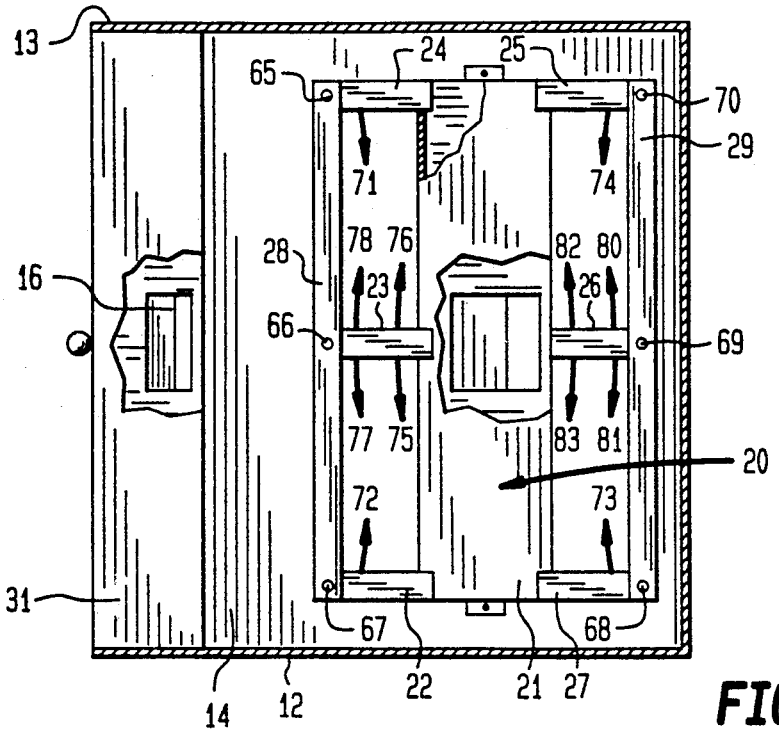
FIG. 4 is a top sectional view taken along section line 4—4 on FIG. 2.

Referring to FIG. 4 depicting grate 20, it will be noted that there are apertures or holes at the top of each leg. These are indicated as front holes 65, 66, and 67 and rear holes 68, 69, and 70. The sideward-inner facing portions of the side legs are further provided with holes near the top, and these are indicated by reference characters 71, 72, 73, and 74, and the middle legs are provided with holes on either side and they are indicated as front holes 75, 76, 77, and 78 and rear holes 79, 80, 81, and 82. It may be noted that holes 76 and 77 are at a relatively small elevation with respect to the top surface of hollow base 21 while holes 80 and 81 are at a higher level. The arrows disposed at the locations of the holes are intended to indicate the presence of an air flow when firechamber 10 is operative. The size, number and location of the apertures are determined by the nature of the desired burning process of the fuel contained in zone I on grate 20. In the successfully operated illustrated embodiment, the apertures were at approximately the indicated locations and were sized in the range of 24/64" to 34/64" and the front top apertures and side exiting aperture were approximately the same size while the top rear apertures were larger. The flow of combustion air through the sideward-facing apertures is what is necessary to continue pyrolizaton of the fuel at the desired rate while the air admitted from the top openings on the riser tubes is to permit the secondary burning to take place within zones II, III and IV.

OPERATION OF THE ILLUSTRATED EMBODIMENT

Referring now to the drawings, assuming that a quantity of fuel has been placed intermediate the upwardly extending legs of grate 20 and that combustion has been initiated as by applying suitable tinder or other igniting material to the lower portions of the fuel in position, knob 62 on regulator rod 55 is pulled forward to move front and rear slides 56 and 60 forwardly to open holes 15 and 16, respectively, to initiate the flow of combustion air into the hollow base of grate 20 and into front plenum 31. The flow of air through hole 15 into the hollow base of grate 20 is the primary source of air for the combustion of the fuel disposed in and on grate 20. As may be appreciated, the presence of the fuel on and in grate 20 causes the air passing therethrough to be heated so that air at a lower temperature is eminated from holes 76 and 77; air at a slightly higher temperature is eminated from holes 80 and 81; air of a still higher temperature is eminated from holes 71, 72, 73, and 74; and, air of a still higher temperature is eminated upwardly from holes 65, 66, 67, 68, 69, and 70. The air from the holes in the side of the legs of grate 20 will be applied directly across and to the indicated portions of the volume encompassed by grate 20, and the air emanating from the top holes will provide heated secondary air for continuing the process of combustion of unburned gases in zones II, III and IV.

As combustion continues, baffles 34, 35, 36, 38 and 39 direct the flow of the heated products of combustion upwardly and into and around refractory materials 46 disposed in the rack between baffles 38 and 39, and above the first secondary burning volume II. As combustion continues, the refractory materials attain a temperature sufficient to continue the combustion process of unburned gases in second secondary burning volume III and then upwardly into third secondary burning volume IV and then into flue 19.

During the initial stages of combustion when there is a likelihood of smoke and the like, hole 16 is maintained in an open position and air may flow therethrough from air duct 32 through perforated plenum cover 37, outwardly into contact with the inner surface of the glass panels on doors 50 and 52 and upwardly therefrom to the top of the forward edge of firechamber 10 whereat the flow may be divided by V-shaped deflector 45, and the air will flow to the top and sides of the refractory materials and complete the combustion of any unburned materials thereat.

It may now be appreciated that my firechamber may be fabricated of any suitable material possessing the necessary physical, structural, and heat accommodating characteristics. For example, it is contemplated that a structure may be comprised of suitable refractory material, such as ceramics, fire brick and the like to provide the necessary primary and secondary burning volumes, the air supply and the baffles for directing the flow of combustion products.

While the illustrated embodiment represents an operative embodiment which has demonstrated the principles of my invention, it may be clear that one skilled in the art may determine, through simple experimentation, the exact size and location of apertures for supplying combustion air as well as the location and nature of the baffles for directing the flow of products of combustion. As one example, one might provide a plenum such as lower front plenum 31, at the inside rear of a firechamber assembly and provide a supply of air for the secondary combustion occurring in zone IV. Other modifications may occur to those skilled in the art without departing from the substance and spirit of my invention, and it is therefore my intention, that my invention will be defined solely by the appended claims.

I claim:

1. In combination with a fireplace of the class having a sealed firechamber disposed over a plenum connected to a source of combustion air and in communication with a flue for exhausting combustion products adjacent the top thereof;

(a) hollow fuel supporting means, operable to receive a quantity of fuel to be burned, and having a plurality of apertures disposed at different elevations with respect to the base of a firechamber and at different locations peripherally about said quantity of fuel whereby the air supplied to the lower peripheral portions of said quantity of fuel is cooler than the air supplied to the top peripheral portion.

2. The subject matter of claim 1 in which a porous refractory means is disposed intermediate the fuel supporting means and an exhaust flue and further air is directed toward and beyond the refractory means.

3. The subject matter of claim 2 in which baffle means are disposed in the firechamber to direct the flow of products of combustion from the fuel supporting means to the exhaust flue.

4. The apparatus of claim 3 in which valve means are disposed to control the flow of air to the hollow fuel supporting means.

5. The apparatus of claim 4 in which the valve means are also used to control a further flow of air beyond the porous refractory means.

6. The apparatus of claim 5 in which the front of the firebox includes access doors and the further flow of air passes over the interior of said doors.

7. The apparatus of claim 1 in which the apparatus is constructed of metal.

8. The apparatus of claim 1 in which the apparatus is constructed of refractory material.

9. In a fireplace of the class having a sealed firechamber disposed over a plenum connected to a source of air for combustion and communicated with a flue for exhausting products of combustion at the top end thereof;

(a) hollow fuel support means, including a plurality of apertures disposed at different elevations with respect to the base of a fireplace chamber, said support means operable to receive combustible fuel elements, disposed over a plenum to a source of air through adjustable valving means to regulate the flow of combustion air to apertures in said fuel supporting means, said last named means being disposed to convey air into a firechamber in proximity to the peripheral portions of a supply of fuel in said fuel supporting means whereby a cooler primary air is directed toward the bottom and intermediate portions and a hotter secondary air is directed above the top portions of said fuel.

10. The method of burning solid fuel in a closed chamber or firebox comprising the steps of;

(a) depositing a quantity of fuel to be burned near the bottom of a firechamber having a flue near the top for exhausting products of combustion;

(b) supplying sufficient air to said fuel to effect pyrolization of the fuel at a desired rate; heating and supplying air adjacent the top of said fuel into a first secondary burning volume for the products of combustion at the top of said fuel;

(d) providing a pourous heat retaining refractory material over said first secondary burning volume;

(e) directing the products of combustion from said first secondary burning volume through said pourous refractory material to heat said material and effect a second secondary buring volume adjacent said material;

(f) directing combustion air adjacent the top of said refractory material to establish a third secondary burning volume to effect a burning of the products of combustion thereat; and (g) exhausting the remaining products of combustion to an exhaust flue adjacent the top of said refractory material.

11. The method of claim 10 in which flow control means impede the flow of products of combustion adjacent the secondary combustion volumes to stabilize the temperature for successive secondary combustions.

* * * * *